US005970898A

United States Patent [19]

Pereira

[11] Patent Number: 5,970,898

[45] Date of Patent: Oct. 26, 1999

[54] JET SKI

[76] Inventor: Fred A. Pereira, 73-1232 Ahikawa At., Kailua-Kona, Hi. 96740

[21] Appl. No.: 09/092,848

[22] Filed: Jun. 8, 1998

[51] Int. Cl.[6] ..... B63H 25/44

[52] U.S. Cl. ..... 114/55.5; 114/55.57; 114/145 R; 114/363

[58] Field of Search ..... 114/145 R, 145 A, 114/55.5, 55.52, 55.54, 55.57, 363

[56] References Cited

U.S. PATENT DOCUMENTS

| | | | |
|---|---|---|---|
| 1,875,344 | 9/1932 | Kloen . | |
| 2,402,379 | 6/1946 | Ganahl | 114/145 R |
| 2,940,409 | 6/1960 | Chaffee . | |
| 4,188,904 | 2/1980 | Childress . | |
| 4,915,049 | 4/1990 | Nakamura et al. . | |
| 5,255,626 | 10/1993 | Hattori et al. . | |
| 5,309,861 | 5/1994 | Mardikian . | |
| 5,603,281 | 2/1997 | Harvey et al. . | |
| 5,697,317 | 12/1997 | Pereira | 114/145 R |
| 5,813,357 | 7/1997 | Watson | 114/145 R |

*Primary Examiner*—Stephen Avila
*Attorney, Agent, or Firm*—Patent & Trademark Services; Joseph H. McGlynn

[57] ABSTRACT

A water craft that has an adjustable steering column to fit the physical characteristics of individual riders, a shock absorber system for the seat and a braking and suspension system to improve handling characteristics and safety while a user is riding the craft. In addition, the craft has a multi-hull design which also improves the handling characteristics and safety.

14 Claims, 4 Drawing Sheets

JET SKI

BACKGROUND OF THE INVENTION

This invention relates, in general, to jet skies, and, in particular, to a jet ski with improved handling characteristics.

DESCRIPTION OF THE PRIOR ART

In the prior art various types of water crafts have been proposed. For example, U.S. Pat. No. 1,875,344 to Kloen discloses a boat having a plurality of brakes operated by handles.

U.S. Pat. No. 2,940,409 to Chaffee discloses a water craft having sidehauls and a center haul.

U.S. Pat. No. 4,188,904 to Childress discloses a steering mechanism for a water craft having an adjustable steering handle.

U.S. Pat. No. 4,915,049 to Nakamura et al discloses a jet ski having adjustable handle bars.

U.S. Pat. No. 5,255,626 to Hattori et al discloses a jet ski having a hull with side and center hauls.

U.S. Pat. No. 5,309,861 to Mardikian discloses a jet ski having a seat with a shock absorber system.

U.S. Pat. No. 5,603,281 to Harvey et al discloses a jet ski having a seat with a shock absorber system.

SUMMARY OF THE INVENTION

The present invention is directed to a water craft that has an adjustable steering column to fit the physical characteristics of individual riders, a shock absorber system for the seat and a braking and suspension system to improve handling characteristics and safety while a user is riding the craft.

It is an object of the present invention to provide a new and improved water craft that has an adjustable steering column to tailor the steering column to individual riders.

It is an object of the present invention to provide a new and improved water craft that has a shock absorbing seat to improve the comfort of the rider.

It is an object of the present invention to provide a new and improved water craft that has an improved suspension and braking system.

These and other objects and advantages of the present invention will be fully apparent from the following description, when taken in connection with the annexed drawings.

DESCRIPTION OF THE PREFERRED EMBODIMENT

Figure 1:
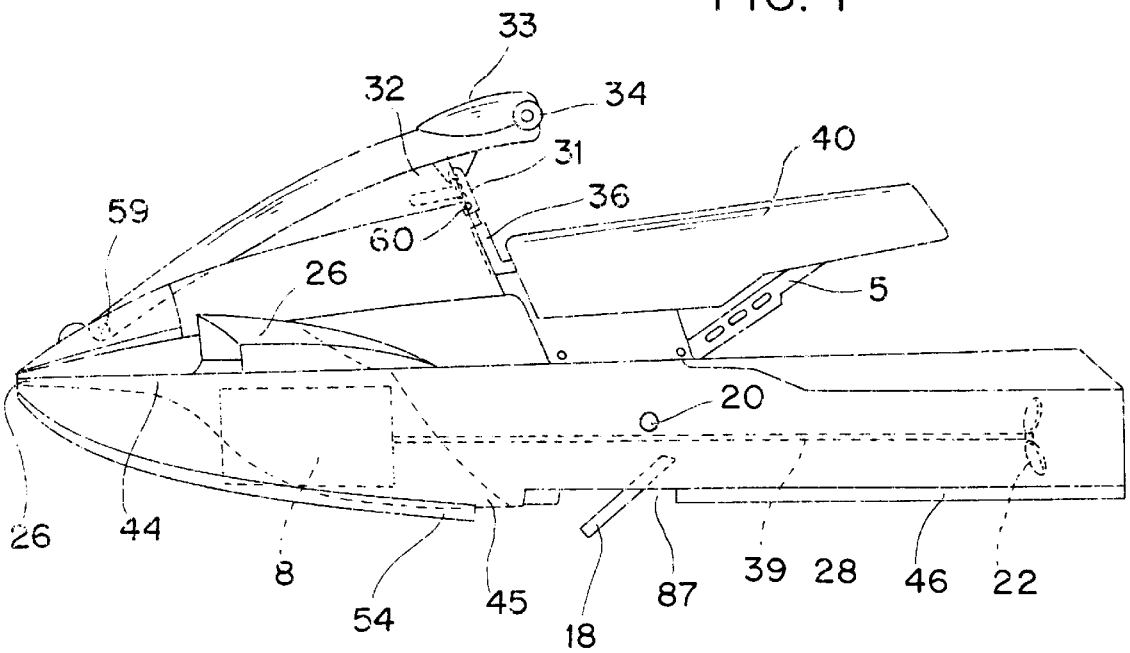
FIG. 1 is a side view of the water craft of the present invention.

Referring now to the drawings in greater detail, FIG. 1 shows a side view of the water craft 62 of the present invention. The craft includes any conventional motor 8, a drive shaft 39, and a prop 22, which will propel the craft. Although a conventional prop 22 is shown in the drawings, this is merely for illustrational purposes, and any type of propulsion means can be used.

Figure 2:
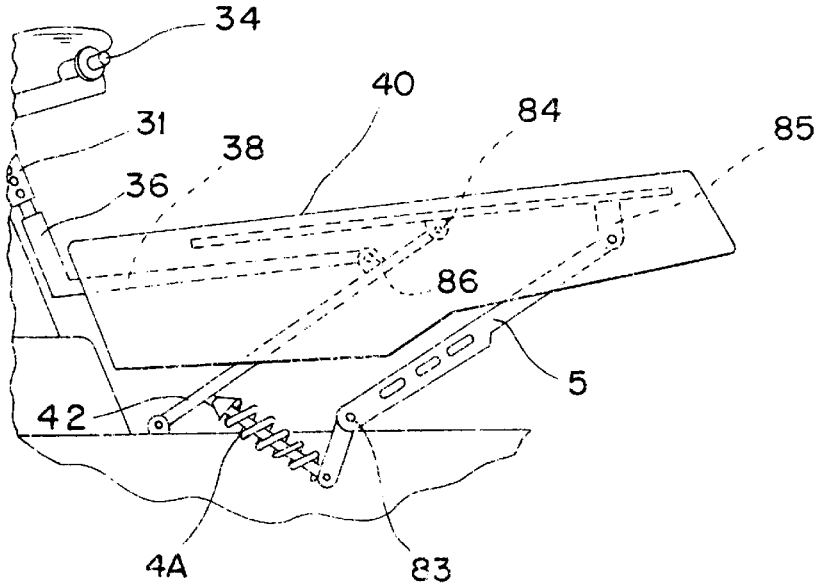
FIG. 2 is a partial side view of the present invention.

The craft also includes a center hull 24, side hulls 28, (see FIG. 7) a seat 40 which has a pair of seat supports 5, 42 (only support 5 is shown in FIG. 1, support 42 is shown in FIG. 2). Seat support 5 is connected to a shock absorber 4A, as shown in FIG. 2. In addition, a steering column 32 with hand grips 34 and chin cushion 33 is pivotally connected at one end by a pivot pin 59 position near the front of the craft. The height of the steering column 32 is adjustable by means of an extension arm 31 which has a series of holes 60 spaced along its length. A steering column support 36 is telescopically connected at one end to the extension arm 31 and secured thereto by a pin which passes through one of the holes 60 and then through a corresponding hole (not shown) on the portion of the steering column support 36 which is received within the extension arm 31.

The height of the steering arm 32 can be changed by aligning one of the holes 60 in the extension arm 31 with the corresponding hole (not shown) on the portion of the steering column support 36 which is received within the extension arm 31 and then placing a pin through the aligned holes. To change the height of the steering arm 32 a different hole 60 can be aligned with the corresponding hole (not shown) on the portion of the steering column support 36 which is received within the extension arm 31 and then placing a pin through the newly aligned holes.

By adjusting the height of the steering arm, it can be custom fitted to riders of different sizes. Therefore, a short rider will not have to stretch to reach the handle bar grips 34, and a taller rider will not have to stoop to reach the handle bar grips 34. If the steering arm is positioned properly for the rider, he/she will be better balanced while riding. This will allow the rider to have better balance while putting the water craft through turns, and he/she will be able to remain on the craft and not be thrown off during violent turning movements of the water craft.

This function of the adjustable steering arm will make the water craft safer to ride. The steering column support is attached at one end to the extension arm 31 and has another end of 36 which passes beneath the seat 40 and is connected at 86, by any conventional means, to the front seat support arm 42.

Figure 4:
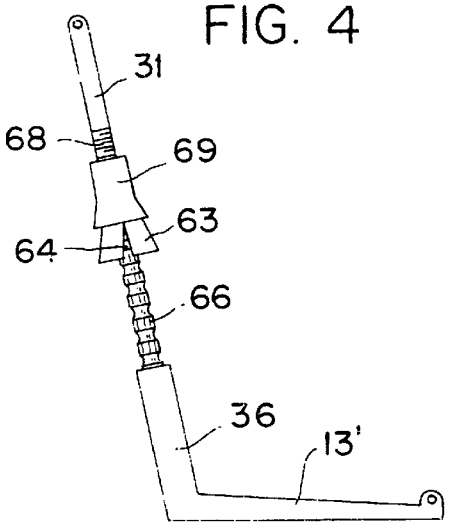
FIG. 4 is a side view of another embodiment of the adjustable steering arm mechanism of the water craft of the present invention.
Figure 5:
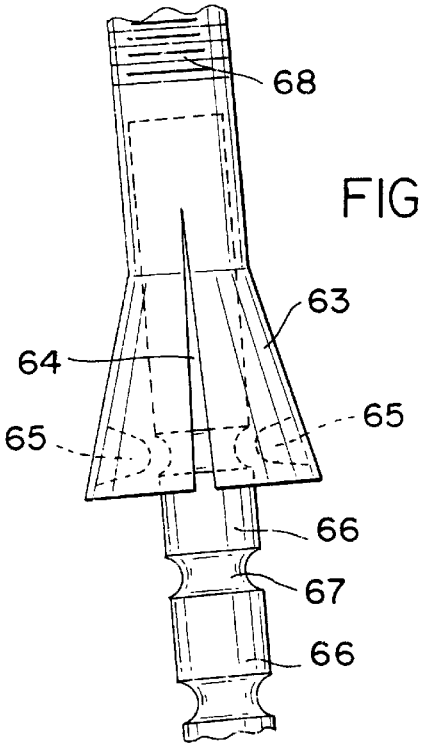
FIG. 5 is a partial enlarged view of a portion of FIG. 4.

FIGS. 4 and 5 show another embodiment of an adjustment for the steering column 32 that can be used with the water craft 62 of the present invention. In this embodiment, the extension arm 31 has a large end 63 on one end which has a slot 64 to make this end resilient. A pair of protrusions 65 are formed on an inner surface of the end 63 (see FIG. 5). The steering column support 36 has a series of lands 66 which are separated by grooves or slots 67, as shown in FIG. 5. The inner dimension between the protrusions 65, when the protrusions 65 are not spread apart, is less than the outer dimension of the lands 66, and approximately equal to the outer dimension of the grooves or slots 67.

Extension arm 31 has a portion of its outer surface threaded as at 68. A nut 69 with its inner surface threaded is passed over arm 63 in order to act as a squeezing mechanism for the slot 64. When a user wants to raise the height of the steering column 32 he/she loosens the nut 69 until the slot 64 separates and pulls protrusions 65 out of the grooves or slots 67. The user then pulls the steering column 32 up until it is in the proper position. Then he/she tightens the nut 69 which forces the slot 64 closed and forces the protrusions 65 into one of the grooves 67, which will secure the arm 31 to the steering column support 36.

When a user wants to lower the height of the steering column 32 he/she merely loosens the nut 69 until the slot 64 separates and pulls protrusions 65 out of the grooves or slots 67. The user then pushes the steering column 32 down until it is in the proper position. Then he/she tightens the nut 69 which forces the slot 64 closed and forces the protrusions 65 into one of the grooves or slots 67, which will secure the arm 31 to the steering column support 36.

It should be noted that in FIG. 5, the nut 69 has been removed for clarity.

Figure 6:
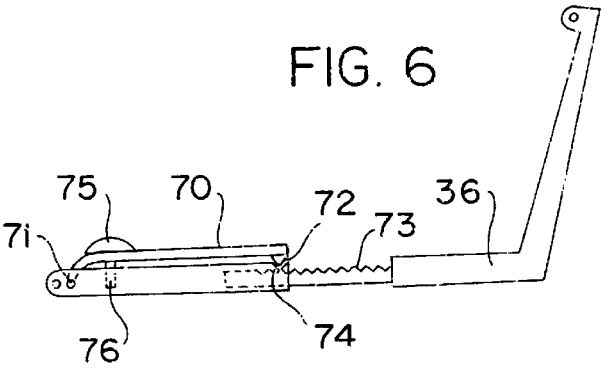
FIG. 6 is a side view of another embodiment of the adjustable steering arm mechanism of the water craft of the present invention.

Another embodiment of the adjustable extension arm is shown in FIG. 6. In this embodiment the extension arm 31 receives the steering column support 36 which has a portion with a series of notches or slots 73. The extension arm 31 has a arm 70 which is pivoted at one end at 71 to the extension arm 31, and has a projection 72 which will engage one of the notches or slots 73 in order to lock the extension arm 31 at a particular height to the steering column support 36. The extension arm 31 has an aperture 74 beneath the projection 72 which allows the projection to pass through the side of the extension arm 31 and into one of the notches or slots 73.

In order to move the arm 70, a threaded adjustment knob 75 is provided. The stem 76 of the adjustment knob 75 passes through an aperture in the arm 70 and is threaded into another aperture in the extension arm 31. By turning the knob closer to the extension arm 31 the arm 70 can be moved into engagement, and by turning the knob away from the extension arm 31 the arm 70 can be moved out of engagement. In all other respects, the embodiment of FIG. 6 operates in the same manner as the embodiment of FIG. 5.

The water craft of the present invention also incorporates a braking system, which also increases the safety of the craft. As shown in FIG. 1, a brake plate 18 is pivotally mounted in the bottom of the side hulls 28 of the craft in a recess 87. The side hull 28 immediately surrounding the brake plate 18 is hollow, so when the brake is applied, the forward end of the plate pivots down and the rearward end of the plate pivots up. This will allow water to enter the hollow side hull 28. The weight of the accumulated water in the hull will increase the braking power many times when compared to the ordinary brake which is usually merely a flat plate which is moved down into the water. In effect, the brake plate 18 and the hollow portions of the hull 28 act just like a parachute as it fills with air and slows a person's decent. The accumulation of water in the hollow portion of the hull will bring the craft much more quickly to a halt, thereby increasing the safety of the craft.

Figure 7:
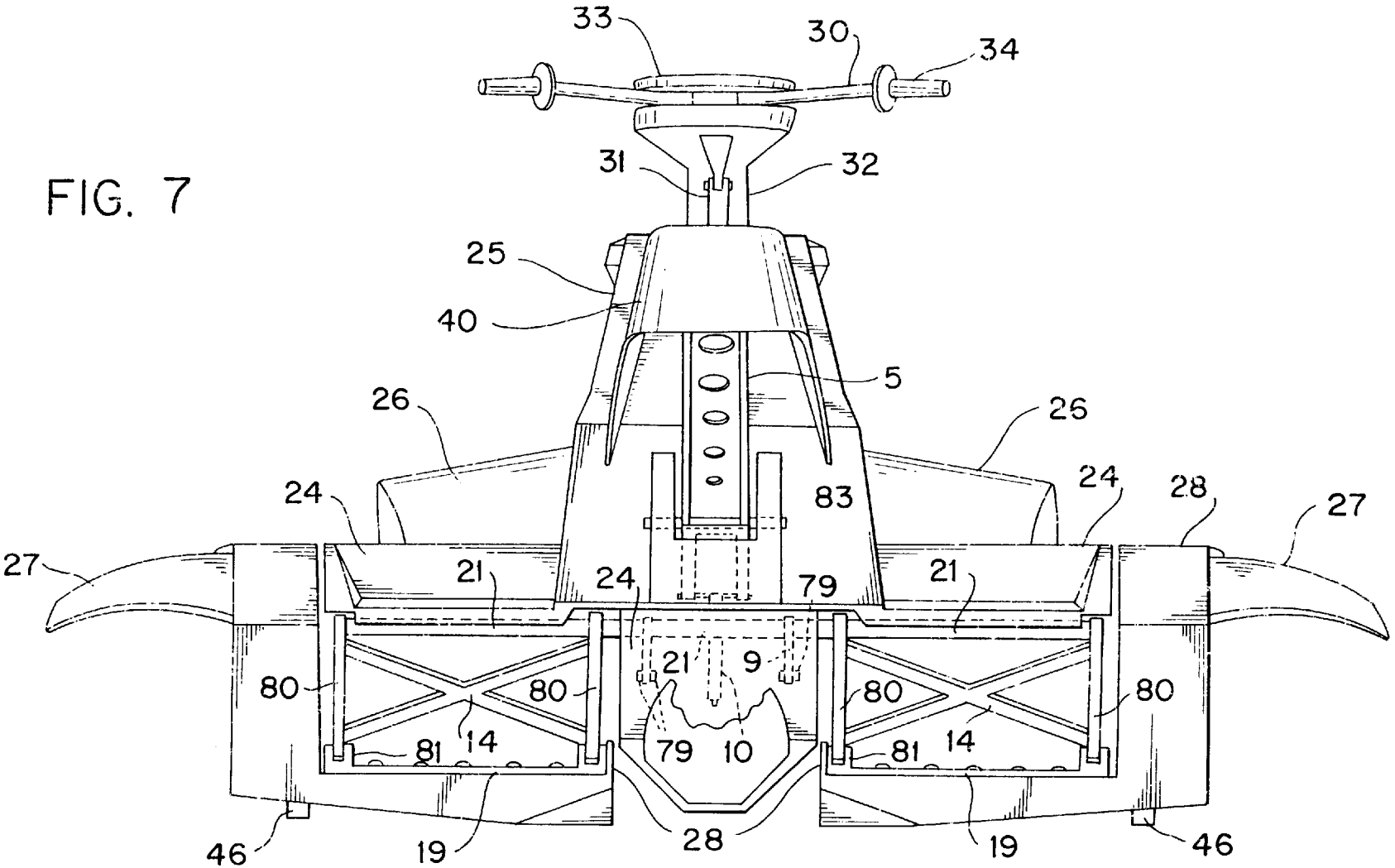
FIG. 7 is a rear view of the present invention showing the three sections of the hulls.

As can be seen in FIG. 7, the rear end of the side hulls 28 are open in the rear and, therefore, any water which accumulates in the side hulls during a braking maneuver, will be forced out the open back end when the craft resumes forward motion.

Figure 3:
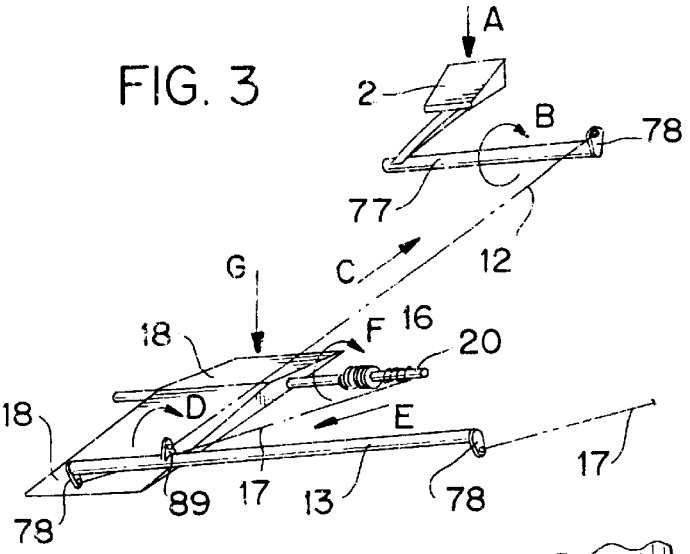
FIG. 3 is a schematic view showing the braking mechanism of the water craft of the present invention.

FIG. 3 shows the various components that make up the braking mechanism and how they cooperate to operate the brake 18. It should be noted that only a single brake 18 is shown in the figure, however, more than one brake can be added to the mechanism. A foot pedal 2 is positioned in a location that is accessible by the rider. When the pedal 2 is depressed in the direction shown by the arrow A, the shaft 77, connected to the pedal and the flange 78, is rotated in the direction shown by the arrow B. The wire 12 is then pulled in the direction shown by arrow C, which pulls the flange 89 which rotates the shaft 13 in the direction of the arrow D. The wire 17. which is attached to flange 78 at one end and is wrapped around shaft 20 at the other end, will then be pulled in the direction of the arrow E, which will rotate the shaft 20 in the direction shown by the arrow F. The brake 18 is non-rotatably attached to the shaft 20, and therefore, the brake 18 will rotate with the shaft 20, and the front end of the brake will move in the direction of the arrow G, allowing water to engage the top surface of the brake 18 and enter the side hulls 28.

As the shaft 20 is rotated it will tension the spring 16. When the pedal 2 is released, the spring 16 will move the shaft 20, and all the other elements connected directly or indirectly to the shaft, back to their original positions. It should be noted that additional brakes 18 could be connected to the shaft 20 if desired.

As shown in FIG. 1, the bottom of the side hulls 28 have a pair of skids positioned thereon. One of the skids 54 is positioned toward the front of the craft, and the other skid 46 is positioned toward the rear of the craft. These skids will act in the same manner as hydrofoils. That is, as the craft accelerates, the craft will rise up on the skids and only the skids will engage the surface of the water. Since the surface of the skids is much smaller than the entire surface of the bottom of the craft 62, the craft will be able to move faster over the surface of the water since there will be less area in contact with the water and therefore, less drag on the craft.

One of the problems associated with hydrofoils is that a fast moving craft will create a vacuum between the bottom of the hull of the craft and the surface of the water. This vacuum will prevent the craft from rising up on the skids 46, 54. In order to break the vacuum that could be built up between the bottom of the craft and the surface of the water, an air intake 26 is positioned at the front of the craft. Connected to this air intake is a duct 44 which leads down to an air exit 45 at the bottom of the craft. As the craft speeds up air is forced into the inlet 26, by the forward motion of the craft, passes through the duct 44 and is forced out the air exit 45 at the bottom of the craft. As the air is forced out, any vacuum that has built up between the bottom of the hull and the surface of the water will be broken by the air moving out of exit 45. This will allow the craft to rise up on the skids or hydrofoils 46, 54 and go faster.

Figure 8:
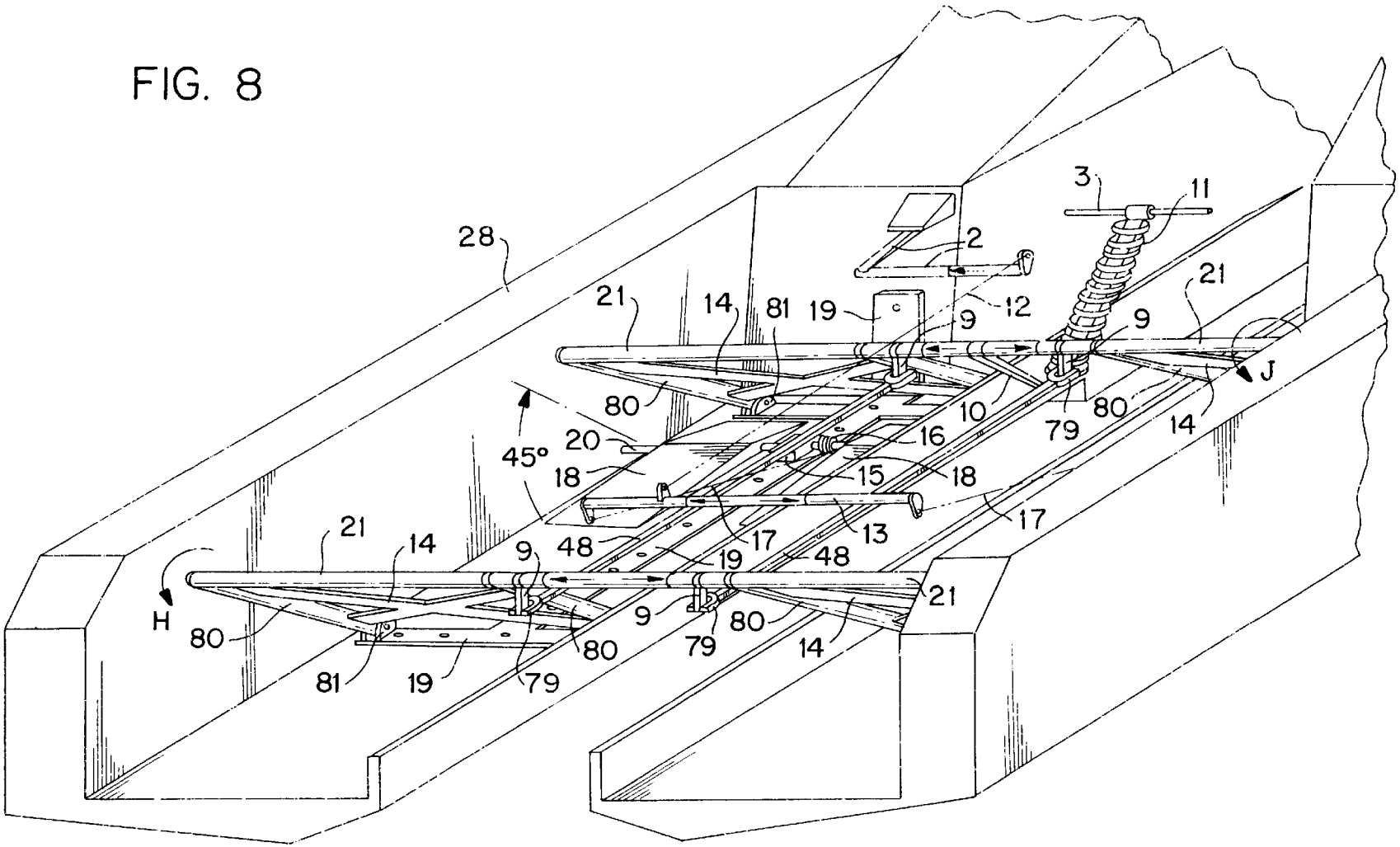
FIG. 8 is a partial perspective view of the side hulls of the present invention (with the center hull removed for clarity) showing the internal mechanism for connecting the movable side hulls.

As shown in FIG. 7, the hull of the water craft of the present invention is made in three sections. The center section 24 has operating components such as the handle bar 30, grips 34, the seat 40, the seat support arm 5, and the prop 22. Attached on opposite sides of the center hull 24 is two side hulls 28. Each side hull 28 has a back wing 27 attached thereto. As shown in FIGS. 1 and 8, the side hulls 28 are connected to the center hull 24 by bars 21 which extend from one side hull 28 to the opposite side hulls 28. The bars 21 extend through the center hull 24 and are connected to each side hull 28 by brackets 19, and can be connected to the hulls in it any conventional water tight manner.

Since the side hulls 28 are movable with respect to the center hull 24, the side hulls will act as a balance when the water craft is moving through the water. That is, as a wave hits the side hull, and perhaps the wing 27, it will tend to raise the side hull on one side of the craft, which will tend to flip the craft over. In order to provide greater stability to the water craft of the present invention, the side hulls 28 are movable, up and down, with respect to the center hull 24. This will provide greater stability since the side hull, hit by a wave, will move up with respect to the center hull thereby absorbing some of the energy.

A normal craft, i.e. one that has a single piece hull, will act as a "cantilever beam" when struck by a wave. If the craft shown in FIG. 7 were a single piece hull, a wave hitting the right side of the craft will exert a force similar to a weight on the end of a "cantilever beam" with the left side of the craft acting as the fixed point of the "cantilever beam". The width of the craft would be the equivalent of the length of the "cantilever beam" and the weight of the wave would exert an overturning force on the craft equal to the weight times the length of the "cantilever beam".

However, in the present invention, since the side hull 28, on the right side of the craft shown in FIG. 7, can move with respect to the center hull 24, the width of the "cantilever beam" is reduced to the width of the side hull 28 on the right side of the craft. Therefore, the overturning force on the present invention would be the weight of the wave times the width of the side hull, which would be considerably less.

In addition to this obvious advantage achieved by making the side hulls movable with respect to the center hull, the dampening mechanism shown in FIG. 8 will make the craft even more stable. Shock absorber 11 is connected to the center hull 24 by means of axle shock support 3 which can be attached to the center hull 24 by any conventional means. The shock absorber 11 will act similar to a shock absorber in an automobile and prevent the center hull from oscillating continuously. The bottom of the shock absorber 11 is connected to a shock swing arm 10. The other end of the shock swing arm 10 is connected to the forward main suspension axle 21 so that as forward main suspension axle 21 moves in the direction of the arrow J (as shown in FIG. 8) the shock swing arm 10 will rotate to compress the shock absorber 11.

Near the bottom of shock absorber 11 is a pair of push bars 48 which are connected on one end to the forward main suspension axle 21, and at their other ends to rearward main suspension axle 21. Crank arms 9 are attached to the forward and rearward main suspension axles 21 and they engage into the fork shaped ends 79 on the opposite ends of the push rods 48. Vertical support rods 80 are connected to the forward and rearward main suspension axles 21 and are braced by the X-shaped support braces 14. The rods 80 are connected to the floor of the side hulls 28 by brackets 19.

As a wave hits the bottom of the side hull 28 or arm 27, they will tend to move upward. This upward force will be transmitted through the flanges 19 to the arms 80 and cross braces 14, which in turn will transfer the force to the axles 21.

Since the axles 21 are positioned at an angle with respect to the flanges 19, the arms 80 and cross braces 14, the axles will rotate downwardly as shown by the arrow H in FIG. 8. Since the center hull 24 is connected to the axles 21, the center hull will remain in contact with the water as the outer hulls 28 move upwardly. The seat 40 which is mounted in the center hull, and on which the rider is mounted, will, therefore, be insulated from the up and down movement of the side hulls 28. This will provide a more stable ride for the user and the up and down movement of the side hulls 28 will absorb some of the energy imparted to the craft by the water. All of these factors will make the water craft more stable and, therefore, more stable.

As the center hull 24 move downward, in the direction of the arrow H, the flange 9 on the rear axle 21 will move the push rod 48 forward, as seen in FIG. 8, which will help to rotate the front axle 21 in the direction of the arrow J. This will cause the shock swing arm 10 to push up on the bottom of the shock absorber 11, thereby compressing it. The shock absorber 11 will act similar to a shock absorber in an automobile and prevent the center hull from oscillating continuously.

Although the Jet Ski and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A water craft having:

means for propelling the craft, a hull, means for steering the craft, means for braking the craft, and a seat upon which a user of the craft may sit, and wherein said means for steering the craft comprises a steering arm pivotally attached at one end adjacent a front of the craft, said steering arm also being attached adjacent a second end of said steering arm by an adjustable means for allowing said second end of said steering arm to be moved up or down in order to position said steering arm with respect to an individual user of said craft, said adjustable means comprising:

a first arm attached adjacent said second end of said steering arm, a second arm detachably attached to said first arm, said first arm having at least one projection secured thereto, and said second arm having a plurality of slots thereon, said at least one projection being secured in one of said plurality of slots to hold said first arm in a first position with respect to said second arm, and said at least one projection being secured in another of said plurality of slots to hold said first arm in a second position with respect to said second arm.

2. The water craft as claimed in claim 1, wherein said first arm has an enlarged portion adjacent said second arm, said enlarged portion having a slot therein, thereby separating said enlarged portion into a first section and a second section, at least one of said first and second sections having said projection attached to an interior surface, and said first arm having means for closing said slot and thereby moving said projection.

3. The water craft as claimed in claim 2, wherein said first and second sections both have a projection attached to an interior surface.

4. The water craft as claimed in claim 2, wherein said means for closing said slot is a threaded section on said first arm, and a nut means for moving along said threaded section.

5. The water craft as claimed in claim 1, wherein said first arm has a third arm pivotally attached at one end to said first arm, said third arm has said projection attached to a second end of said third arm, and means for moving said second end of said third arm toward said first arm.

6. The water craft as claimed in claim 5, wherein said means for moving said second end of said third arm toward said first arm is a knob having a threaded shaft which passes through said third arm and is secured to said first arm.

7. The water craft as claimed in claim 1, wherein said hull has hydrofoils attached to a bottom portion thereof, said hull also has an air intake opening mounted on a front portion of said hull, a duct connected at one end to said air intake, said duct having a second end with an air exit, said air exit being positioned on said bottom portion of said hull.

8. The water craft as claimed in claim 1, wherein said hull is composed of three sections, one of said sections being a center hull and two other sections being side hulls, said side hulls being separate from said center hull.

9. The water craft as claimed in claim 8, wherein said side hulls have a front portion and a rear portion, said entire rear portion of said side hulls being open.

10. The water craft as claimed in claim 8, wherein said side hulls are connect to said center hull by at least two horizontal bars, said bars engaging said center hull adjacent a center portion of said bars, and a first support flange having a first end engaging a first end of said bar, a second support flange having a first end engaging a second end of said bars, said first support flange having a second end which engages one of said side hulls, and said second support flange having a second end which engages another of said side hulls.

11. The water craft as claimed in claim 10, wherein said water craft has a third support flange connected to said horizontal bar, said third support flange is parallel to said first support flange, and wherein said water craft has a fourth support flange connected to said horizontal bar, said fourth support flange is parallel to said second support flange, and an X-shaped member is connected between said first and third support flanges, and another X-shaped member is connected between said second and fourth support flanges.

12. The water craft as claimed in claim 10, wherein said bars are interconnected by a push rod, said push rod having a U-shaped end on opposite ends of said push rod, each of said U-shaped ends engaging a flange on one of said bars, and one of said bars having an arm depending therefrom, said arm being permanently attached at one end to said one of said bars, and said arm being connected at another end to a shock absorber.

13. A water craft having:

means for propelling the craft, a hull, means for steering the craft, means for adjusting said means for steering said craft upwards and downwards with respect to said hull, means for braking the craft, and a seat upon which a user of the craft may sit, and wherein said means for braking the craft comprises a plate pivotally mounted with respect to a bottom portion of said hull, means for moving said plate from a first position where it is positioned within said bottom portion of said hull to a second position where a first portion of said plate extends from said bottom portion of said hull, and a second portion of said plate is entirely within said hull, and wherein said means for moving said plate from a first position to a second position comprises:

a pedal, said pedal being attached to a first shaft, said first shaft having an end of a first wire attached thereto, a second end of said first wire being attached to a second shaft, said second shaft having an end of a second wire attached thereto, a second end of said second wire being attached to a third shaft, said third shaft being attached to said plate pivotally mounted with respect to a bottom portion of said hull.

14. A water craft having:

means for propelling the craft, a hull, means for steering the craft, means for adjusting said means for steering said craft upwards and downwards with respect to said hull, means for braking the craft, and a seat upon which a user of the craft may sit, and suspension means for attaching said seat to said hull, said suspension means comprising:

at least a first arm and a second arm, each of said first and second arms being attached at a first end to said seat, and each of said first and second arms being attached at a second end to said hull, and wherein a first end of a shock absorber is attached adjacent said second end of said first arm, and a third arm attached to a second end of said second arm, said shock absorber having a first end attached to said first arm and second end attached to said third arm.

* * * * *